US008038750B2

(12) United States Patent
Pribyl et al.

(10) Patent No.: US 8,038,750 B2
(45) Date of Patent: Oct. 18, 2011

(54) STRUCTURED ABRASIVE WITH OVERLAYER, AND METHOD OF MAKING AND USING THE SAME

(75) Inventors: Joseph G Pribyl, Forest Lake, MN (US); Karunasena Alahapperuma, Woodbury, MN (US); Craig F. Lamphere, Woodbury, MN (US); Edward J. Woo, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 759 days.

(21) Appl. No.: 11/777,701

(22) Filed: Jul. 13, 2007

(65) Prior Publication Data

US 2009/0017727 A1 Jan. 15, 2009

(51) Int. Cl.

| | |
|---|---|
| ***B24B 1/00*** | (2006.01) |
| ***B24D 11/00*** | (2006.01) |
| ***B24D 3/02*** | (2006.01) |
| ***C09K 3/14*** | (2006.01) |
| ***C09C 1/68*** | (2006.01) |

(52) U.S. Cl. ..... 51/295; 51/298; 51/307

(58) Field of Classification Search ..... 51/295, 51/298, 307; 451/28, 526, 532, 536; 428/147
See application file for complete search history.

(56) References Cited

U.S. PATENT DOCUMENTS

| | | | | |
|---|---|---|---|---|
| 2,072,051 | A * | 2/1937 | Van Der Pyl | 451/546 |
| 4,311,489 | A | 1/1982 | Kressner | |
| 4,609,581 | A | 9/1986 | Ott | |
| 4,652,274 | A | 3/1987 | Boettcher et al. | |
| 4,652,275 | A | 3/1987 | Bloecher et al. | |
| 4,735,632 | A | 4/1988 | Oxman et al. | |
| 4,751,138 | A | 6/1988 | Tumey et al. | |
| 4,799,939 | A | 1/1989 | Bloecher et al. | |
| 4,903,440 | A | 2/1990 | Larson et al. | |
| 4,985,340 | A | 1/1991 | Palazzotto et al. | |
| 5,086,086 | A | 2/1992 | Brown-Wensley et al. | |
| 5,152,917 | A | 10/1992 | Pieper et al. | |
| 5,236,472 | A | 8/1993 | Kirk et al. | |
| 5,254,194 | A | 10/1993 | Ott et al. | |
| 5,286,782 | A | 2/1994 | Lamb et al. | |
| 5,354,797 | A | 10/1994 | Anderson et al. | |
| 5,376,428 | A | 12/1994 | Palazzotto et al. | |
| 5,378,251 | A | 1/1995 | Culler et al. | |

(Continued)

FOREIGN PATENT DOCUMENTS

WO WO 92/05915 A1 4/1992

OTHER PUBLICATIONS

Woo et al., "Structured Abrasive Article and Method of Making and Using the Same", U.S. Appl. No. 11/380,444, filed Apr. 27, 2006.

*Primary Examiner* — Anthony Green
*Assistant Examiner* — Pegah Parvini
(74) *Attorney, Agent, or Firm* — Bradford B. Wright

(57) ABSTRACT

A structured abrasive article comprises a backing with a topographically structured abrasive layer secured thereto. The topographically structured abrasive layer comprises precisely-shaped abrasive composites. A solid overlayer comprising eroding particles with a Mohs scale hardness of at least 4 and a water-soluble polymer is disposed on at least a portion of the topographically structured abrasive layer. Methods of making and using the structured abrasive articles are also disclosed.

20 Claims, 2 Drawing Sheets

U.S. PATENT DOCUMENTS 5,385,954 A 1/1995 Palazzotto et al.
5,435,816 A 7/1995 Spurgeon et al.
5,454,844 A 10/1995 Hibbard et al.
5,672,097 A 9/1997 Hoopman
5,672,186 A 9/1997 Chesley et al.
5,681,217 A 10/1997 Hoopman et al.
5,714,259 A 2/1998 Holmes et al.
5,733,178 A 3/1998 Ohishi
5,833,724 A 11/1998 Wei et al.
5,851,247 A * 12/1998 Stoetzel et al. ..... 51/295
5,888,119 A 3/1999 Christianson et al.
5,910,471 A 6/1999 Christianson et al.
5,928,070 A * 7/1999 Lux ..... 451/526
5,928,394 A 7/1999 Stoetzel
5,942,015 A 8/1999 Culler et al.
5,975,987 A 11/1999 Hoopman et al.
5,989,111 A 11/1999 Lamphere et al.
6,139,594 A 10/2000 Kincaid et al.
6,155,910 A 12/2000 Lamphere et al.
6,231,629 B1 5/2001 Christianson et al.
6,428,898 B1 8/2002 Barsotti et al.
6,451,076 B1 * 9/2002 Nevoret et al. ..... 51/298
6,465,076 B2 * 10/2002 Larson et al. ..... 428/143
6,544,593 B1 4/2003 Nagata et al.
6,638,144 B2 10/2003 Sventek et al.
6,899,592 B1 * 5/2005 Kojima et al. ..... 451/6
7,150,770 B2 12/2006 Keipert et al.
7,150,771 B2 12/2006 Keipert et al.
7,169,031 B1 1/2007 Fletcher et al.
2002/0009514 A1 1/2002 Hoopman et al.
2003/0022604 A1 1/2003 Annen et al.
2003/0143938 A1 7/2003 Braunschweig et al.
2005/0060942 A1 3/2005 Culler et al.
2005/0060944 A1 3/2005 Culler et al.
2005/0060947 A1 3/2005 McArdle et al.
2005/0064805 A1 3/2005 Culler et al.
2005/0113005 A1 5/2005 Woo et al.
2006/0288647 A1 12/2006 Thurber et al.
2007/0026770 A1 2/2007 Fletcher et al.

* cited by examiner

STRUCTURED ABRASIVE WITH OVERLAYER, AND METHOD OF MAKING AND USING THE SAME

BACKGROUND

For years, a class of abrasive articles known generically as "structured abrasive articles" has been sold commercially for use in surface finishing. Structured abrasive articles have a topographically structured abrasive layer affixed to a backing, and are often used in conjunction with a liquid such as, for example, water, optionally containing surfactant. The topographically structured abrasive layer has a plurality of shaped abrasive composites (typically having minute size), each having abrasive particles dispersed a binder. In many cases, the shaped abrasive composites are precisely-shaped, for example, according to various geometric shapes (e.g., pyramids). Examples of such structured abrasive articles include those marketed under the trade designation "TRIZACT" by 3M Company, St. Paul, Minn., and which are used in the automotive industry to remove defects in automotive clear coats (e.g., as available under the trade designation "466LA-3M TRIZACT FINESSE-IT FILM") based on urethane, acrylate, or silicate based chemistries.

Structured abrasive articles are often used in combination with a backup pad mounted to a tool (e.g., a disk sander or a random orbit sander). In such applications, structured abrasive articles typically have an attachment interface layer (e.g., a hooked film, looped fabric, or adhesive) that affixes them to the back up pad during use.

Many structured abrasive articles are known to lack aggressive cut upon initial use, with improvements in cut seen with continued use. This can occur because the abrasive particles are buried in the binder within the body of the abrasive composite and are not available for abrading. One technique used in the art for addressing the problem of lower initial cut has been to abrade the abrasive surface of the structured abrasive article, prior to its initial use, using another coated abrasive article such as sandpaper.

The cut performance of current products is very sensitive to the type of workpiece coating materials, which may be based on various kinds of technologies such as polyurethane, acrylate, powder coatings, or even silicate based hard coatings reinforced with nanoparticles.

SUMMARY

In one aspect, the present invention provides a structured abrasive article comprising:

a backing having first and second opposed major surfaces;

a topographically structured abrasive layer secured to the backing, the topographically structured abrasive layer comprising precisely-shaped abrasive composites, wherein the precisely-shaped abrasive composites comprise abrasive particles in a cross-linked polymeric binder, and wherein the abrasive particles have a $D_{50}$; and a solid overlayer disposed on at least a portion of the topographically structured abrasive layer, the solid overlayer comprising eroding particles with a Mohs scale hardness of at least 4 and a water-soluble polymer, wherein the eroding particles have a $D_{50}$ that is less than or equal to the $D_{50}$ of the abrasive particles.

In some embodiments, the water-soluble polymer comprises at least one of a polyvinyl alcohol, a poly(vinylpyrrolidone), a poly(alkylene oxide), a copolymer of methyl vinyl ether and maleic anhydride, a cellulosic polymer, guar gum, or an acrylic polymer. In some embodiments, the backing comprises a film backing. In some embodiments, the eroding particles comprise at least one of silicon carbide or aluminum oxide. In some embodiments, the eroding particles have a lesser Mohs hardness than at least a portion of the abrasive particles. In some embodiments, the solid overlayer is continuous. In some embodiments, the precisely-shaped abrasive composites have a height, relative to the backing, in a range of from 10 to 525 micrometers. In some embodiments, the structured abrasive article further comprises an attachment interface layer affixed to the second major surface of the backing. In some embodiments, the cross-linked polymeric binder comprises at least one component selected from the group consisting of acrylics, phenolics, epoxies, urethanes, cyanates, isocyanurates, aminoplasts, and combinations thereof. In some embodiments, the abrasive particles are selected from the group consisting of aluminum oxide, fused aluminum oxide, heat-treated aluminum oxide, ceramic aluminum oxide, silicon carbide, green silicon carbide, alumina-zirconia, ceria, iron oxide, garnet, diamond, cubic boron nitride, and combinations thereof. In some embodiments, the abrasive particles have a $D_{50}$ in a range of from 0.01 to 200 micrometers.

Structured abrasive articles according to the present invention are useful, for example, for abrading a workpiece. In another aspect, the present invention provides a method of abrading a workpiece, the method comprising:

frictionally contacting at least a portion of the topographically structured abrasive layer of the structured abrasive article according to the present invention with a workpiece while in the presence of water; and moving at least one of the workpiece or the topographically structured abrasive layer relative to the other to abrade at least a portion of the surface of the workpiece.

In yet another aspect, the present invention provides a method of making a structured abrasive article, the method comprising:

providing a structured abrasive article comprising:

a backing having first and second opposed major surfaces; and a topographically structured abrasive layer secured to the backing, the topographically structured abrasive layer comprising precisely-shaped abrasive composites, wherein the precisely-shaped abrasive composites comprise abrasive particles in a cross-linked polymeric binder, and wherein the abrasive particles have a $D_{50}$; and disposing a solid overlayer on at least a portion of the topographically structured abrasive layer, the solid overlayer comprising eroding particles with a Mohs scale hardness of at least 4 and a water-soluble polymer, wherein the eroding particles have a $D_{50}$ that is less than or equal to the $D_{50}$ of the abrasive particles.

In some embodiments, the method further comprises affixing an attachment interface layer to the second major surface of the backing.

In some embodiments, disposing the solid overlayer comprises: coating a liquid mixture onto at least a portion of the topographically structured abrasive layer, the liquid mixture comprising the eroding particles, water-soluble polymer, and a liquid vehicle; and removing a sufficient amount of the liquid vehicle to provide the solid overlayer. In some of these embodiments, coating the liquid mixture comprises at least one of roll coating or spraying.

Advantageously, structured abrasive articles having an overlayer, even at very light coating levels, according to the present invention exhibit improved initial cut as compared to corresponding structured abrasive articles lacking the solid overlayer, effectively eliminating the need for a separate conditioning step prior to use.

Further, structured abrasive articles having an overlayer according to the present invention are found to be practical for surface finishing of powder clear coats, not previously achieved for corresponding structured abrasive articles without the solid overlayer.

As used herein, the term "$D_{50}$" in reference to particles refers to the volume-based median particle size; that is, the particle size at which 50 percent by volume of the particles have an equal or smaller particle size;

the term "polymer" refers to any of numerous natural and synthetic compounds having a molecular weight of at least 1000 grams per mole and having repeated linked units, each unit being a relatively light and simple molecule; and the term "precisely-shaped" used to describe abrasive composites refers to abrasive composites having a shape that is defined by relatively smooth-surfaced sides that are bounded and joined by well-defined sharp edges having distinct edge lengths with distinct endpoints defined by the intersections of the various sides.

DETAILED DESCRIPTION

Figure 1:
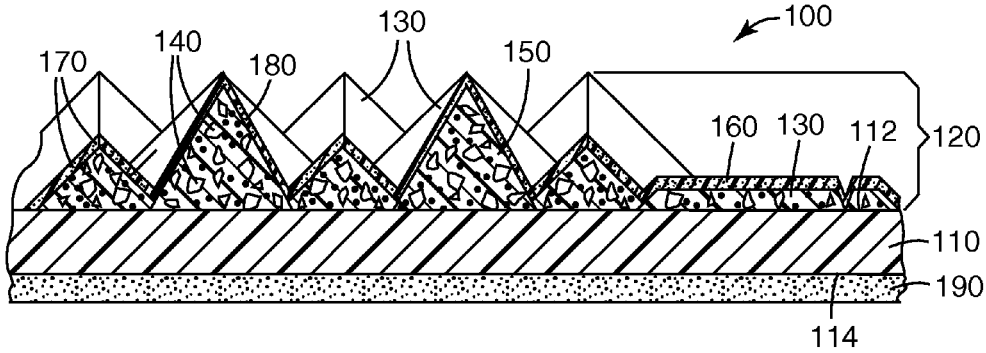
FIG. 1 is a schematic cross-sectional side view of an exemplary structured abrasive with overlayer detailed description according to one embodiment of the present invention.

Referring now to FIG. 1, exemplary structured abrasive article 100 comprises backing 110, which has first and second opposed major surfaces 112, 114, respectively, and topographically structured abrasive layer 120 secured to backing 110. Topographically structured abrasive layer 120 comprises precisely-shaped abrasive composites 130. Precisely-shaped abrasive composites 130 comprise abrasive particles 140 in a cross-linked polymeric binder 150. Solid overlayer 160 is disposed on at least a portion of topographically structured abrasive layer 120. Solid overlayer 160 comprises eroding particles 170 with a Mohs scale hardness of at least 4 and water-soluble polymer 180. Eroding particles 170 have a $D_{50}$ that is less than or equal to the $D_{50}$ of abrasive particles 140. Optional attachment interface layer 190 is affixed to second major surface 114 of backing 110.

Suitable backings include, for example, polymeric films (including primed polymeric film), cloth, paper, foraminous and non-foraminous polymeric foam, vulcanized fiber, fiber reinforced thermoplastic backing, meltspun or meltblown nonwovens, treated versions thereof (e.g., with a waterproofing treatment), and combinations thereof. Suitable thermoplastic polymers for use in polymeric films include, for example, polyolefins (e.g., polyethylene, and polypropylene), polyesters (e.g., polyethylene terephthalate), polyamides (e.g., nylon-6 and nylon-6,6), polyimides, polycarbonates, blends thereof, and combinations thereof. Typically, at least one major surface of the backing is smooth (for example, to serve as the first major surface). The backing may contain various additive(s). Examples of suitable additives include colorants, processing aids, reinforcing fibers, heat stabilizers, UV stabilizers, and antioxidants. Examples of useful fillers include clays, calcium carbonate, glass beads, talc, clays, mica, wood flour; and carbon black.

The backing may have any thickness, but is generally thick enough to provide cohesive integrity and thin enough to allow a degree of flexibility, although the backing may be rigid if desired. The backing may comprise a treated backing having one or more treatments thereon (e.g., a backsize, subsize, presize, tie layer, a primer layer, and/or saturant). The backing may comprise a composite film such as, for example, a coextruded film having two or more discrete layers. The second major surface of the backing may comprise a slip resistant or frictional coating. Examples of such coatings include an inorganic particulate (e.g., calcium carbonate or quartz) dispersed in an adhesive.

The topographically structured abrasive layer is secured to the backing such that it does not separate from the backing during intended use. Typically, the topographically structured abrasive layer directly contacts the backing and is secured during curing of the cross-linked polymeric binder, however it may be secured to the backing other means such as, for example, by an adhesive layer (e.g., a hot melt adhesive layer).

The precisely-shaped abrasive composites may have any precise shape, but typically comprise pyramidal abrasive composites, truncated pyramidal abrasive composites, prismatic abrasive composites, yurt-shaped abrasive composites, or a mixture thereof. The term "pyramidal abrasive composite" refers to an abrasive composite having the shape of a pyramid, that is, a solid figure with a polygonal base and triangular faces that meet at a common point (apex). Examples suitable precisely-shaped abrasive composites include three-sided, four-sided, five-sided, and six-sided pyramidal abrasive composites, truncated pyramid abrasive composites, prismatic abrasive composites, and yurt-shaped abrasive composites. Combinations of differently shaped precisely-shaped abrasive composites and/or different heights of precisely-shaped abrasive composites may also be used. For example, pyramidal precisely-shaped abrasive composites may be interspersed with truncated pyramidal precisely-shaped abrasive composites of lesser height. The precisely-shaped abrasive composites may be regular (having all sides identical) or irregular.

The precisely-shaped abrasive composites define the topographically structured abrasive layer and are typically arranged in close-packed arrangements (e.g., arrays) wherein adjacent precisely-shaped abrasive composites contact one another at their respective bases, although separation between at least some adjacent precisely-shaped abrasive composites is permissible. Gaps (e.g., stripes) in the topographically structured abrasive layer may be present.

The height of the precisely-shaped abrasive composites relative to the backing is typically in a range of from at least 10 micrometers to 600 micrometers, although the height may be more or less. More typically, the height of the precisely-shaped abrasive composites relative to the backing is in a range of from 10 micrometers to 525 micrometers, or even in a range of from 10 micrometers to 100 micrometers.

For fine finishing applications, the areal density of the precisely shaped abrasive composites in the topographically structured abrasive layer is typically in a range of from at least 1,000, 10,000, or even at least 20,000 abrasive composites per square inch (e.g., at least 150, 1,500, or even 7,800 abrasive composites per square centimeter) up to and including 50,000, 70,000, or even as many as 100,000 abrasive composites per square inch (up to and including 7,800, 11,000, or even as many as 15,000 abrasive composites per square centimeter), although greater or lesser densities of abrasive composites may also be used.

Any abrasive particles known in the abrasive art may be included in the abrasive composites. Examples of useful abrasive particles include aluminum oxide, fused aluminum oxide, heat-treated aluminum oxide (which includes brown aluminum oxide, heat treated aluminum oxide, and white aluminum oxide), ceramic aluminum oxide, silicon carbide, green silicon carbide, alumina-zirconia, chromia, ceria, iron oxide, garnet, diamond, cubic boron nitride, and combinations thereof. For repair and finishing applications, useful abrasive particle sizes typically range from at least 0.01, 0.1, 1, 3 or even 5 micrometers up to and including 35, 50, 100, or even 200 micrometers, although particle sizes outside of this range may also be used. In some embodiments, the $D_{50}$ of the abrasive particles ranges from at least 0.01, 0.1, 1, 3 or even 5 micrometers up to and including 35, 50, 100, or even 200 micrometers, although $D_{50}$ values outside of this range may also be used.

The abrasive particles may be bonded together (by other than the binder) to form an agglomerate, such as described, for example, in U.S. Pat. No. 4,311,489 (Kressner); and U.S. Pat. Nos. 4,652,275 and 4,799,939 (both to Bloecher et al.).

The abrasive particles may have a surface treatment thereon. In some instances, the surface treatment may increase adhesion to the binder, alter the abrading characteristics of the abrasive particle, or the like. Examples of surface treatments include coupling agents, halide salts, metal oxides including silica, refractory metal nitrides, and refractory metal carbides.

The abrasive composites (whether pyramidal or truncated pyramidal) may also comprise diluent particles, typically with sizes on the same order of magnitude as the abrasive particles. Examples of such diluent particles include gypsum, marble, limestone, flint, silica, glass bubbles, glass beads, and aluminum silicate.

The abrasive particles are dispersed in a binder to form the abrasive composite. The cross-linked polymeric binder is generally formed from a corresponding curable binder precursor. During the manufacture of the structured abrasive article, the curable binder precursor is exposed to an energy source which aids in the curing process. Examples of energy sources include thermal energy and radiation energy which includes electron beam, ultraviolet light, and visible light.

During curing, the curable binder precursor is converted into a solidified binder by formation of a cross-linked polymeric material. Upon sufficient curing that solidification of the curable binder precursor occurs, which need not be complete curing, the abrasive composite is formed.

There are two main classes of thermosetting resins, condensation curable and addition polymerizable resins. Addition polymerizable resins are advantageous because they are readily cured by exposure to radiation energy. Addition polymerized resins can polymerize through a cationic mechanism or a free radical mechanism. Depending upon the energy source that is utilized and the binder precursor chemistry, a curing agent, initiator, or catalyst is sometimes preferred to help initiate the polymerization.

Examples of typical binder precursors include phenolic resins, urea-formaldehyde resins, aminoplast resins, urethane resins, melamine formaldehyde resins, cyanate resins, isocyanurate resins, acrylate resins (e.g., acrylated urethanes, acrylated epoxies, ethylenically unsaturated compounds, aminoplast derivatives having pendant alpha,beta-unsaturated carbonyl groups, isocyanurate derivatives having at least one pendant acrylate group, and isocyanate derivatives having at least one pendant acrylate group) vinyl ethers, epoxy resins, and combinations thereof. As used herein, term "acrylate" encompasses both acrylates and methacrylates.

Phenolic resins are suitable for this invention and have good thermal properties, availability, and relatively low cost and ease of handling. There are two types of phenolic resins, resole and novolac. Resole phenolic resins have a molar ratio of formaldehyde to phenol of greater than or equal to one to one, typically between about 1.5:1.0 to 3.0:1.0. Novolac resins have a molar ratio of formaldehyde to phenol of less than one to one. Examples of commercially available phenolic resins include those known by the trade designations "DUREZ" and "VARCUM" from Occidental Chemicals Corp., Dallas, Tex.; "RESINOX" from Monsanto Co., Saint Louis, Mo.; and "AEROFENE" and "AROTAP" from Ashland Specialty Chemical Co., Dublin, Ohio.

Acrylated urethanes are typically diacrylate esters (although they may have more or less acrylate functionality) of hydroxy-terminated NCO-extended polyesters or polyethers. Examples of commercially available acrylated urethanes include those available under the trade designations "UVITHANE 782" from Morton Thiokol Chemical, and "CMD 6600", "CMD 8400", and "CMD 8805" from UCB Radcure, Smyrna, Ga.

Acrylated epoxies are diacrylate esters of epoxy resins, such as the diacrylate esters of bisphenol A epoxy resin. Examples of commercially available acrylated epoxies include those available under the trade designations "CMD 3500", "CMD 3600", and "CMD 3700" from UCB Radcure.

Ethylenically unsaturated resins include both monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 g/mole and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of acrylate resins include methyl methacrylate, ethyl methacrylate styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol methacrylate, pentaerythritol tetraacrylate and pentaerythritol tetraacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryloyl-oxyethyl)isocyanurate, 1,3,5-tri(2-methacryloxyethyl)-s-triazine, acrylamide, methylacrylamide, N-methylacrylamide, N,N-dimethylacrylamide, N-vinylpyrrolidone, and N-vinylpiperidone.

The aminoplast resins have at least one pendant alpha,beta-unsaturated carbonyl group per molecule or oligomer. These unsaturated carbonyl groups can be acrylate, methacrylate, or acrylamide type groups. Examples of such materials include N-(hydroxymethyl)-acrylamide, N,N'-oxydimethylenebisacrylamide, ortho- and para-acrylamidomethylated phenol, acrylamidomethylated phenolic novolac, and combinations thereof. These materials are further described in U.S. Pat. Nos. 4,903,440 and 5,236,472 (both to Kirk et al.).

Isocyanurate derivatives having at least one pendant acrylate group and isocyanate derivatives having at least one pendant acrylate group are further described in U.S. Pat. No. 4,652,274 (Boettcher et al.). An example of one isocyanurate material is the triacrylate of tris(hydroxyethyl) isocyanurate.

Epoxy resins have one ore more oxirane ring(s) and are polymerized by ring opening. Such epoxide resins include monomeric epoxy resins and oligomeric epoxy resins. Examples of useful epoxy resins include 2,2-bis[4-(2,3-epoxypropoxy)-phenyl propane] (diglycidyl ether of bisphenol) and materials available under the trade designations "EPON 828", "EPON 1004", and "EPON 1001F" from Resolution Performance Products, Houston, Tex.; and "DER-331", "DER-332", and "DER-334" from Dow Chemical Co., Midland, Mich. Other suitable epoxy resins include glycidyl ethers of phenol formaldehyde novolac commercially available under the trade designations "DEN-431" and "DEN-428" from Dow Chemical Co.

The epoxy resins of the invention can polymerize via a cationic mechanism with the addition of an appropriate cationic curing agent. Cationic curing agents generate an acid source to initiate the polymerization of an epoxy resin. These cationic curing agents can include a salt having an onium cation and a halogen containing a complex anion of a metal or metalloid.

Other cationic curing agents include a salt having an organometallic complex cation and a halogen containing complex anion of a metal or metalloid which are further described in U.S. Pat. No. 4,751,138 (Tumey et al.). Another example is an organometallic salt and an onium salt is described in U.S. Pat. No. 4,985,340 (Palazzotto et al.); U.S. Pat. No. 5,086,086 (Brown-Wensley et al.); and U.S. Pat. No. 5,376,428 (Palazzotto et al.). Still other cationic curing agents include an ionic salt of an organometallic complex in which the metal is selected from the elements of Periodic Group IVB, VB, VIB, VIIB and VIIIB which is described in U.S. Pat. No. 5,385,954 (Palazzotto et al.).

Regarding free radical curable resins, in some instances it is preferred that the abrasive slurry further comprise a free radical curing agent. However in the case of an electron beam energy source, the curing agent is not always required because the electron beam itself generates free radicals.

Examples of free radical thermal initiators include peroxides, e.g., benzoyl peroxide, azo compounds, benzophenones, and quinones. For either ultraviolet or visible light energy source, this curing agent is sometimes referred to as a photoinitiator. Examples of initiators, that when exposed to ultraviolet light generate a free radical source, include but are not limited to those selected from the group consisting of organic peroxides, azo compounds, quinones, benzophenones, nitroso compounds, acryl halides, hydrozones, mercapto compounds, pyrylium compounds, triacrylimidazoles, bisimidazoles, chloroalkytriazines, benzoin ethers, benzil ketals, thioxanthones, and acetophenone derivatives, and mixtures thereof. Examples of initiators that, if exposed to visible radiation, generate a free radical source can be found in U.S. Pat. No. 4,735,632 (Oxman et al.). One suitable initiator for use with visible light is available under the trade designation "IRGACURE 369" from Ciba Specialty Chemicals, Tarrytown, N.Y.

To prepare the topographically structured abrasive layer, a slurry comprising the abrasive particles, curable binder precursor, and any added ingredients for inclusion in the precisely shaped abrasive composites is prepared and urged against a production tool that has a surface of precisely-shaped cavities of complementary shape and arrangement to the desired topographically structured abrasive layer. The slurry is typically then sufficiently cured to solidify it and secure it to the backing, while present in the cavities of the production tool. Next, the backing with the topographically structured abrasive layer attached is separated from the tool thereby forming a structured abrasive article. Additional curing (e.g., post-curing) of the binder may be done at this time or at a later time.

The production tool can be a belt, a sheet, a continuous sheet or web, a coating roll such as a rotogravure roll, a sleeve mounted on a coating roll, or die. The production tool can be composed of metal, (e.g., nickel), metal alloys, or plastic. The metal production tool can be fabricated by any conventional technique such as, for example, engraving, bobbing, electroforming, or diamond turning.

A thermoplastic tool can be replicated from a metal master tool. The master tool will have the inverse pattern desired for the production tool. The master tool can be made in the same manner as the production tool. The master tool is preferably made out of metal, e.g., nickel and is diamond turned. The thermoplastic sheet material can be heated and optionally along with the master tool such that the thermoplastic material is embossed with the master tool pattern by pressing the two together. The thermoplastic can also be extruded or cast onto the master tool and then pressed. The thermoplastic material is cooled to solidify and produce the production tool. Examples of preferred thermoplastic production tool materials include polyester, polycarbonates, polyvinyl chloride, polypropylene, polyethylene and combinations thereof. If a thermoplastic production tool is utilized, then care must be taken not to generate excessive heat that may distort the thermoplastic production tool.

The production tool may also contain a release coating to permit easier release of the abrasive article from the production tool. Examples of such release coatings for metals include hard carbide, nitrides or borides coatings. Examples of release coatings for thermoplastics include silicones and fluorochemicals.

Further details concerning topographically structured abrasive articles having precisely-shaped abrasive composites secured to a backing, and methods for their manufacture may be found, for example, in U.S. Pat. No. 5,152,917 (Pieper et al.); U.S. Pat. No. 5,435,816 (Spurgeon et al.); U.S. Pat. No. 5,672,097 (Hoopman); U.S. Pat. No. 5,681,217 (Hoopman et al.); U.S. Pat. No. 5,454,844 (Hibbard et al.); U.S. Pat. No. 5,851,247 (Stoetzel et al.); U.S. Pat. No. 6,139,594 (Kincaid et al.); and co-pending commonly assigned U.S. application Ser. No. 11/380,444 (Woo et al.).

The solid overlayer, which may be of even or uneven thickness, and which may be continuous or discontinuous, is disposed on at least a portion of the topographically structured abrasive layer. For example, the solid overlayer may be disposed on the topographically structured abrasive layer according to a continuous or discontinuous pattern. More typically, the solid overlayer is disposed on substantially the entire outer surface of the topographically structured abrasive layer (i.e., the abrasive surface).

The solid overlayer comprises eroding particles and a water-soluble polymer.

The eroding particles may comprise any known abrasive material such as, for example, those described herein in reference to the abrasive particles as long as they have a Mohs scale hardness of at least 4 (e.g., a Mohs scale hardness of at least about 4.8), which enables them to abrade the cross-linked polymeric binder and expose the abrasive particles of the abrasive composites. For example, the eroding particles may comprise at least one of silicon carbide or aluminum oxide.

The eroding particles have a $D_{50}$ that is less than or equal to the $D_{50}$ of the abrasive particles, since larger particles can cause undesirable surface scratches to the workpiece. Similarly, the eroding particles may have a lesser Mohs hardness than at least a portion of, or even all of, the abrasive particles which generally lessens their abrasive influence on the workpiece relative to the abrasive particles.

The water-soluble polymer may be any polymer or mixture of polymers that is soluble in water and solidifies under typical ambient and/or packaged conditions, desirably at or slightly above ambient temperatures (e.g., at 25° C. and/or at 40° C.). Examples of suitable water-soluble polymers include: polyvinyl alcohols (e.g., those polyvinyl alcohols having relatively low molecular weight and/or degrees of hydrolysis below about 95 percent), poly(vinylpyrrolidone), poly(alkylene oxide) (e.g., polyethylene oxide and polypropylene oxide waxes), copolymers of methyl vinyl ether and maleic anhydride, cellulosic polymers, guar gum, acrylic polymers, and combinations thereof.

The eroding particles and water-soluble polymer may be presence in any volume ratio (e.g., in a volume ratio of eroding particles to total eroding particles and water-soluble polymer combined of from 5 to 75 percent) as long as there is sufficient water-soluble polymer to retain the eroding particles in the dry state.

The overlayer may have any coating weight, but typically coating weights in a range of from 3.2 to 16 grams per square meter (0.05 to 0.25 grams per 24 square inches) provide a good balance of performance and cost.

The overlayer is typically disposed on the outermost surface of the topographically structured abrasive layer as a dispersion of the eroding particles in a liquid vehicle having the water-soluble polymer dissolved therein followed by a drying step (e.g., in an oven) to remove sufficient liquid vehicle for the overlayer to solidify, although other methods may also be used. The liquid vehicle is typically an aqueous liquid vehicle such as water or a mixture of water and a miscible volatile organic solvent or solvents (e.g., methanol, ethanol, isopropanol, and/or acetone). The overlayer may be applied to the topographically structured abrasive layer as a continuous or discontinuous layer, which may be uniform or non-uniform, patterned or otherwise. Methods of applying dispersions of eroding particles in a liquid vehicle having a water-soluble polymer dissolved therein include, for example, roll coating and spraying.

The back surface of the backing (i.e., the side of the backing opposite the topographically structured abrasive layer) may be printed with pertinent information according to conventional practice to reveal information such as, for example, product identification number, grade number, and/or manufacturer. Alternatively or in addition, the front surface of the backing may be printed with this same type of information if the abrasive composite is translucent enough for print to be legible through the abrasive composites.

Structured abrasive articles according to the present invention may optionally have an attachment interface layer affixed to the second major surface of the backing to facilitate securing the structured abrasive article to a support pad or back-up pad secured to a tool such as, for example, a random orbital sander. The optional attachment interface layer may be an adhesive (e.g., a pressure sensitive adhesive) layer or a double-sided adhesive tape.

The optional attachment interface layer may be adapted to work with one or more complementary elements affixed to the support pad or back up pad in order to function properly. For example, the optional attachment interface layer may comprise a loop fabric for a hook and loop attachment (e.g., for use with a backup or support pad having a hooked structure affixed thereto), a hooked structure for a hook and loop attachment (e.g., for use with a backup or support pad having a looped fabric affixed thereto), or an intermeshing attachment interface layer (e.g., mushroom type interlocking fasteners designed to mesh with a like mushroom type interlocking fastener on a back up or support pad). Further details concerning such attachment interface layers may be found, for example, in U.S. Pat. No. 4,609,581 (Ott); U.S. Pat. No. 5,152,917 (Pieper et al.); U.S. Pat. No. 5,254,194 (Ott); U.S. Pat. No. 5,454,844 (Hibbard et al.); U.S. Pat. No. 5,672,097 (Hoopman); U.S. Pat. No. 5,681,217 (Hoopman et al.); and U.S. Pat. Appl. Publ. Nos. 2003/0143938 (Braunschweig et al.) and 2003/0022604 (Annen et al.).

Likewise, the second major surface of the backing may have a plurality of integrally formed hooks protruding therefrom, for example, as described in U.S. Pat. No. 5,672,186 (Chesley et al.). These hooks will then provide the engagement between the structured abrasive article and a back up pad that has a loop fabric affixed thereto.

Structured abrasive articles according to the present invention can be any shape, for example, round (e.g., a disc), oval, or rectangular (e.g., a sheet) and may have scalloped edges, depending on the particular shape of any support pad that may be used in conjunction therewith, or they may have the form of an endless belt. The structured abrasive articles may have slots or slits therein and may be provided with perforations (e.g., a perforated disc).

Structured abrasive articles according to the present invention are generally useful for abrading a workpiece, and especially those workpieces having a hardened polymeric layer such as, for example, an automotive paint or clear coat thereon.

The workpiece may comprise any material and may have any form. Examples of materials include metal, metal alloys, exotic metal alloys, ceramics, painted surfaces, plastics, polymeric coatings, stone, polycrystalline silicon, wood, marble, and combinations thereof. Examples of workpieces include molded and/or shaped articles (e.g., optical lenses, automotive body panels, boat hulls, counters, and sinks), wafers, sheets, and blocks.

Structured abrasive articles according to the present invention are typically useful for repair and/or polishing of polymeric coatings such as motor vehicle paints and clearcoats (e.g., automotive clearcoats), examples of which include: polyacrylic-polyol-polyisocyanate compositions (e.g., as described in U.S. Pat. No. 5,286,782 (Lamb, et al.); hydroxyl functional acrylic-polyol-polyisocyanate compositions (e.g., as described in U.S. Pat. No. 5,354,797 (Anderson, et al.); polyisocyanate-carbonate-melamine compositions (e.g., as described in U.S. Pat. No. 6,544,593 (Nagata et al.); and high solids polysiloxane compositions (e.g., as described in U.S. Pat. No. 6,428,898 (Barsotti et al.)).

Depending upon the application, the force at the abrading interface can range from about 0.1 kilogram (kg) to over 1000 kg. Generally, this range is between 1 kg to 500 kg of force at the abrading interface. Also, depending upon the application there may be a liquid present during abrading. This liquid can be water and/or an organic compound. Examples of typical organic compounds include lubricants, oils, emulsified organic compounds, cutting fluids, surfactants (e.g., soaps, organosulfates, sulfonates, organophosphonates, organophosphates), and combinations thereof. These liquids may also contain other additives such as defoamers, degreasers, corrosion inhibitors, and combinations thereof. In using structured abrasive articles according to present invention, a liquid comprising at least some water is desirably used to wet the abrading interface during abrading processes.

Structured abrasive articles according to the present invention may be used, for example, with a rotary tool that rotates about a central axis generally perpendicular to the structured abrasive layer, or with a tool having a random orbit (e.g., a random orbital sander), and may oscillate at the abrading interface during use. In some instances, this oscillation may result in a finer surface on the workpiece being abraded.

Objects and advantages of this invention are further illustrated by the following non-limiting examples, but the particular materials and amounts thereof recited in these examples, as well as other conditions and, details, should not be construed to unduly limit this invention.

EXAMPLES

Unless otherwise noted, all parts, percentages, ratios, etc. in the examples and the rest of the specification are by weight.

The following abbreviations are used in the Examples below:

ACR1 2-phenoxyethyl acrylate, commercially available under the trade designation "SR339" from Sartomer Company, Inc., Exton, Pa.;

ACR2 trimethylolpropane triacrylate, commercially available under the trade designation "SR351" from Sartomer Company, Inc.;

BIN1 polyvinyl alcohol, 88 percent hydrolyzed, 31,000 g/mole nominal molecular weight, commercially available under the trade designation "MOWIOL 4-88" from Kuraray Co. Ltd., New York, N.Y.;

BIN2 poly(vinylpyrrolidone), 9,500 g/mole nominal molecular weight, obtained under the trade designation "PVP K-15" from ISP Technologies, Wayne, N.J.;

BIN3 polyvinyl alcohol, 88 percent hydrolyzed, 127,000 g/mole nominal molecular weight, commercially available under the trade designation "MOWIOL 40-88" from Kuraray Co. Ltd.;

BIN4 self-crosslinking acrylic emulsion, 44.5-45.5 percent solids, available under the trade designation "RHOPLEX HA-12" from Rohm & Haas Co., Philadelphia, Pa.;

BIN5 a styrene-butadiene copolymer latex, 49-51 percent solids, obtained under the trade designation "STYRONAL NX 4680" from BASF, Florham Park, N.J.;

BIN6 a UV curable resin pre-mix consisting of 38.2 parts of trimethylolpropane triacrylate obtained from Aldrich Chemical Co., Milwaukee, Wis., 59.8 parts of phenoxyethyl acrylate obtained from Aldrich Chemical Co., 2.0 parts acylphosphine oxide photoinitiator, commercially available under the trade designation "LUCERIN TPO-L" from BASF Corporation, Florham Park, N.J.;

CPA1 gamma-methacryloxypropyltrimethoxysilane, commercially available under the trade designation "SILQUEST A-174" from OSi Specialties, Inc., Danbury, Conn.;

DSP1 a 100 percent active polymeric dispersant, available under the trade designation "SOLPLUS D520" from Lubrizol Corp., Wickliffe, Ohio;

MIN1 green silicon carbide mineral particles, $D_{50}$=3.0 micrometers, commercially available under the trade designation "GC 4000 GREEN SILICON CARBIDE" from Fujimi Corporation, Elmhurst, Ill.;

MIN2 aluminum oxide mineral particles, $D_{50}$=2.0 micrometers, commercially available under the trade designation "WA 6000" from Fujimi Corporation, Elmhurst, Ill.;

MIN3 aluminum oxide mineral particles, $D_{50}$=1.23 micrometers, commercially available under the trade designation "WA 8000" from Fujimi Corporation, Elmhurst, Ill.;

MIN4 calcium metasilicate mineral particles, $D_{50}$=3.5 micrometers, commercially available under the trade designation "NYAD M1250" (Wollastonite) from Nyco Minerals, Willsboro, N.Y.;

MIN5 calcium carbonate mineral particles, $D_{50}$=12-13 micrometers, obtained from J. M. Huber Corp, Edison, N.J.;

MIN6 talc powder mineral particles, $D_{50}$=8-9 micrometers, commercially available under the trade designation "MISTRON 353" from Luzenac North America, Greenwood Village, Colo.;

MIN7 green silicon carbide mineral, $D_{50}$=4.0+/−0.5 micrometers, commercially available under the trade designation "GC 3000 GREEN SILICON CARBIDE" from Fujimi Corporation, Elmhurst, Ill.;

SURF1 1,4-bis(2-ethylhexyl) sodium sulfosuccinate, obtained under the trade designation "TRITON GR-5M" from Dow Chemical Company, Midland, Mich.;

THK1 an anionic thickener, commercially available under the trade designation "ACRYSOL ASE 60" from Rohm and Haas Co., Philadelphia, Pa.; and TP1 an automotive clear coat test panel, commercially available under the trade designation "PPG 9911" from PPG Industries, Alison Park, Pa.

UV1 acylphosphine oxide, commercially available under the trade designation "LUCERIN TPO-L" from BASF Corporation, Florham Park, N.J.

Comparative Example A

Figure 2:
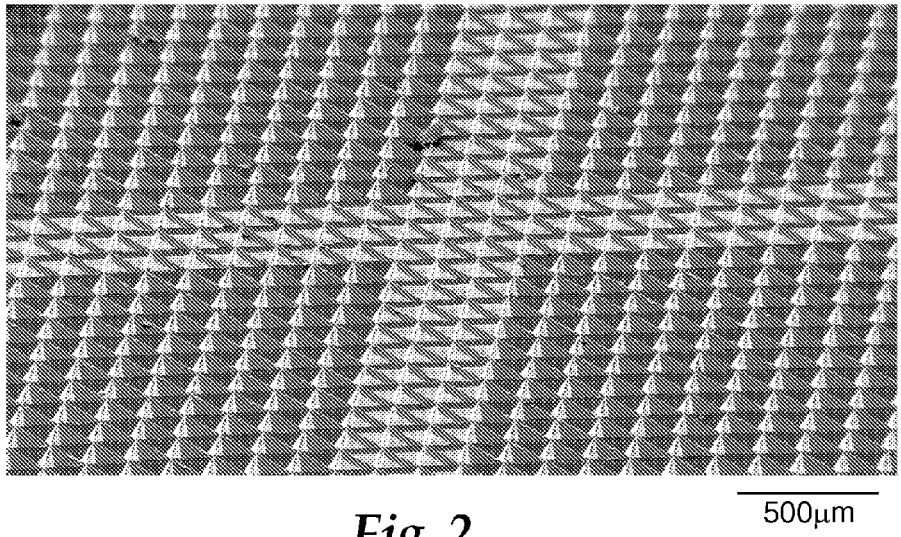
FIG. 2 is a digital micrograph of polypropylene tooling used in Comparative Example A.
Figure 3:
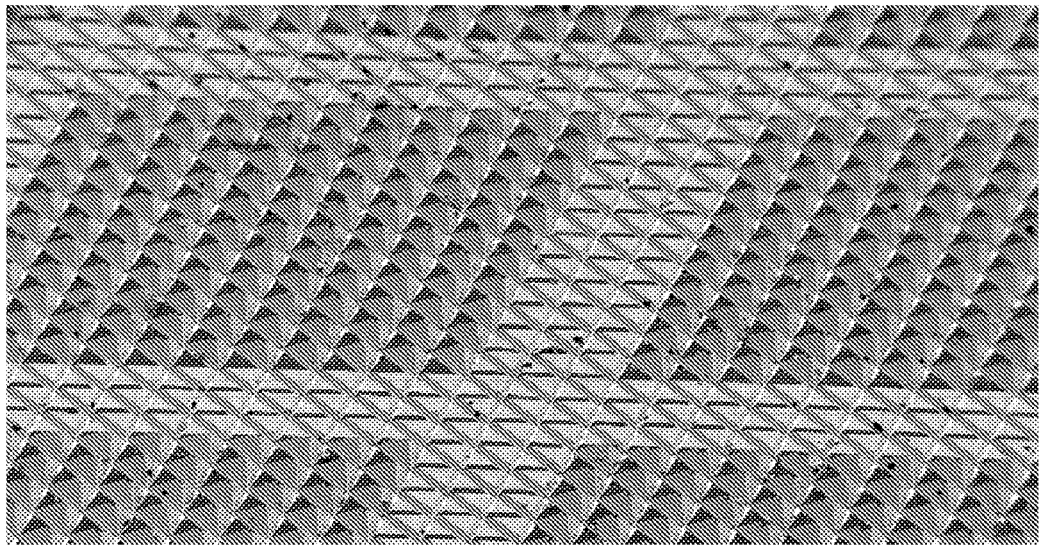
FIG. 3 is a digital micrograph of the structured abrasive article used in Example 1, before coating with any overlayer.

An abrasive slurry defined in parts by weight, was prepared as follows: 13.2 parts ACR1, 20.0 parts ACR2, 0.5 parts DSP1, 2.0 part CPA1, 1.1 parts UVI1 and 63.2 parts MIN7 were homogeneously dispersed for approximately 15 minutes at 20° C. using a laboratory air mixer. The slurry was applied via knife coating to a 12-inch (30.5 cm) wide microreplicated polypropylene tooling having uniformly distributed, close packed, alternating 34 degree helical cut, pyramidal arrays having 11 by 11 rows of base width 3.3 mils by 3.3 mils (83.8 by 83.8 micrometers) by 2.5 mils (63.5 micrometers) depth, separated by 3 by 3 rows of the same pyramidal array truncated to a depth of 0.83 mil (21 micrometers), as shown in FIG. 2 of U.S. application Ser. No. 11/380,444 (Woo et al.). The tool was prepared from a corresponding master roll generally according to the procedure of U.S. Pat. No. 5,975,987 (Hoopman et al.). The slurry filled polypropylene tooling was then laid on the a 12-inch (30.5-cm) wide web of ethylene acrylic acid primed polyester film, 3.71 mil (94.2 micrometers) thick, obtained under the trade designation "MA370M" from 3M Company, passed through a nip roll (nip pressure of 90 pounds per square inch (psi) (620.5 kilopascals (kPa)) for a 10 inch (25.4 cm) wide web), and irradiated with an ultraviolet (UV) lamp, type "D" bulb, from Fusion Systems Inc., Gaithersburg, Md., at 600 Watts/inch (236 Watts/cm) while moving the web at 30 feet/minute (fpm) (9.14 meters/minute). The polypropylene tooling was separated from the ethylene acrylic acid primed polyester film, resulting in a fully cured precisely shaped abrasive layer adhered to ethylene acrylic acid primed polyester film as shown in FIG. 3. Pressure-sensitive adhesive (available under the trade designation "3M SCOTCH BRAND 442KW" from 3M Company) was laminated to the backside (opposite that topographically structured abrasive layer) of the film. Various disc sizes, ranging in diameter from 0.75-inch (1.91-cm) to 1.25-inch (3.18-cm) were then die cut from the abrasive material.

Example 1

A mineral dispersion, in parts by volume (pbv), was prepared according to the following procedure using materials and amounts reported in Table 1. A 20 percent by weight solution of BIN1 in water was prepared. To this solution was added sufficient MIN1 mineral to achieve a mineral content of 20 percent by total volume of dried overlayer. The viscosity of the dispersion was adjusted to a shear viscosity in a range of from 2-3 pascal-seconds by addition of THK1 at a pH of about 9.

Figure 4:
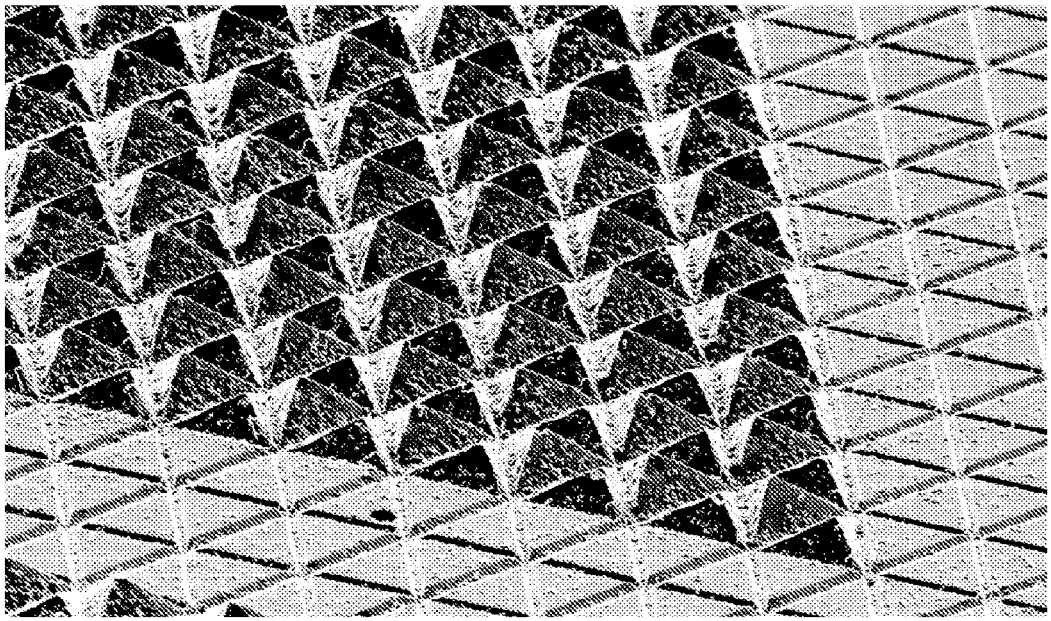
FIG. 4 is a digital micrograph of a structured abrasive article, with a solid overlayer, prepared according to Example 1.

The mineral dispersion was applied via roll coating to a 12-inch (30.5 cm) width of structured abrasive article (SA1) prepared in Comparative Example A. The coated structured abrasive was dried at 150° F. (65.6° C.) for 10 minutes. The resultant structured abrasive with solid overlayer is shown in FIG. 4.

Examples 2-3 and Comparative Examples B-D

Examples 2-3 and Comparative Examples B-D were prepared according to the method described in Example 1, except different polymers, as reported in Table 1, were used to make the mineral dispersion.

Examples 4-6 and Comparative Examples E-F

Examples 4-6 and Comparative Examples E-F were prepared according to the method described in Example 1, except different minerals were used in the mineral dispersion as reported in Table 1.

Examples 7-11

Examples 7-11 were prepared according to the method described in Example 1, except that different mineral concentrations (as reported in Table 1) were used in the mineral dispersion.

Comparative Example G

Comparative Example G was prepared according to the method described in Example 1, except no binder was used in the mineral dispersion, as reported in Table 1.

Comparative Example H

Comparative Example H was prepared according to the method described in Comparative Example G, except that one weight percent of SURF1 was added to the mineral dispersion as reported in Table 1.

Comparative Example I

Comparative Example I was prepared according to the method described in Example 1, except no binder and no mineral was used in mineral dispersion, and one weight percent of SURF1 was added to the mineral dispersion, as reported in Table 1.

Manual De-Nibbing Evaluation

Example 1 and Comparative Example A were evaluated for their ability to remove dust nibs (de-nibbing) in an automotive clearcoat test panel TP1 without concomitant leveling of the surrounding orange peel. Dust nibs in a cured clearcoat (TP1) were identified visually and lightly sprayed with water. A 1.25-inch (3.18-cm) specimen of the structured abrasive article to be evaluated (as reported in Table 1) was attached to a backup pad (1.25-inch (31.8-mm) diameter vinyl face backup pad having a hardness of 40-60 Shore 00, commercially available under the trade designation "3M FINESSE-IT STIKIT BACKUP PAD, PART No. 02345" from 3M Company, St. Paul, Minn.), which was then attached to an air-driven random orbit sander, model number "57502" obtained from Dynabrade, Inc., Clarence, N.Y. A given dust nib (<1 mm outside diameter) on the test panel was abraded in 3 second abrading intervals, using an air line pressure of 90 pounds per square inch (620 kPa), with the center of the abrasive article using the weight of the tool to generate the down force. After each abrading interval, the test panel (TP1) was wiped clean with isopropanol. Visual examination of the abraded test panel at the site of the dust nib was recorded. Results are reported in Table 1 (below).

TABLE 1

| | BINDER/ SURFACTANT | WATER-SOLUBLE POLYMER, yes/no | MINERAL | MINERAL CONCENTRATION BY VOLUME, percent | MOHS SCALE HARDNESS | CUT LIFE, number of dust nibs successfully removed |
|---|---|---|---|---|---|---|
| COMPARATIVE EXAMPLE A | none | no | none | 0 | 0 | 0 |
| EXAMPLE 1 | BIN1 | yes | MIN1 | 20 | 9.25 | ≧7 |
| EXAMPLE 2 | BIN2 | yes | MIN1 | 20 | 9.25 | ≧7 |
| EXAMPLE 3 | BIN3 | yes | MIN1 | 20 | 9.25 | ≧7 |
| COMPARATIVE EXAMPLE B | BIN4 | no | MIN1 | 20 | 9.25 | 0 |
| COMPARATIVE EXAMPLE C | BIN5 | no | MIN1 | 20 | 9.25 | 0 |
| COMPARATIVE EXAMPLE D | BIN6 | no | MIN1 | 20 | 9.25 | 0 |
| EXAMPLE 4 | BIN1 | yes | MIN2 | 20 | 9 | ≧7 |
| EXAMPLE 5 | BIN1 | yes | MIN3 | 20 | 9 | ≧7 |
| EXAMPLE 6 | BIN1 | yes | MIN4 | 20 | 4.8 | ≧7 |
| COMPARATIVE EXAMPLE E | BIN1 | yes | MIN5 | 20 | 3 | 0 |
| COMPARATIVE EXAMPLE F | BIN1 | yes | MIN6 | 20 | 1 | 0 |
| EXAMPLE 7 | BIN1 | yes | MIN1 | 75 | 9.25 | ≧7 |
| EXAMPLE 8 | BIN1 | yes | MIN1 | 50 | 9.25 | ≧7 |
| EXAMPLE 9 | BIN1 | yes | MIN1 | 34 | 9.25 | ≧7 |

TABLE 1-continued

| | BINDER/ SURFACTANT | WATER-SOLUBLE POLYMER, yes/no | MINERAL | MINERAL CONCENTRATION BY VOLUME, percent | MOHS SCALE HARDNESS | CUT LIFE, number of dust nibs successfully removed |
|---|---|---|---|---|---|---|
| EXAMPLE 10 | BIN1 | yes | MIN1 | 10 | 9.25 | ≧7 |
| EXAMPLE 11 | BIN1 | yes | MIN1 | 5 | 9.25 | 2 |
| COMPARATIVE EXAMPLE G | none | not applicable | MIN1 | 100 | 9.25 | 0 |
| COMPARATIVE EXAMPLE H | SURF1 | not applicable | MIN1 | 20 | 9.25 | 0 |
| COMPARATIVE EXAMPLE I | SURF1 | not applicable | none | 0 | 0 | 0 |

Patents, patent applications, and publications cited herein are hereby incorporated herein by reference in their entirety as if individually incorporated.

Various modifications and alterations of this invention may be made by those skilled in the art without departing from the scope and spirit of this invention, and it should be understood that this invention is not to be unduly limited to the illustrative embodiments set forth herein.

What is claimed is:

1. A structured abrasive article comprising:

a backing having first and second opposed major surfaces;

a topographically structured abrasive layer secured to the backing, the topographically structured abrasive layer comprising precisely-shaped abrasive composites, wherein the precisely-shaped abrasive composites comprise abrasive particles in a cross-linked polymeric binder, and wherein the abrasive particles have a $D_{50}$; and a solid overlayer disposed on at least a portion of the topographically structured abrasive layer, the solid overlayer comprising eroding particles with a Mohs scale hardness of at least 4 and a water-soluble polymer, wherein the eroding particles have a $D_{50}$ that is less than or equal to the $D_{50}$ of the abrasive particles, wherein the eroding particles are present in a volume ratio of 5 to 75 percent based on the total of eroding particles and water-soluble polymer combined, and wherein there is sufficient water-soluble polymer to retain the eroding particles in a dry state.

2. The structured abrasive article of claim 1, wherein the water-soluble polymer comprises at least one of a polyvinyl alcohol, a poly(vinylpyrrolidone), a poly(alkylene oxide), a copolymer of methyl vinyl ether and maleic anhydride, a cellulosic polymer, guar gum, or an acrylic polymer.

3. The structured abrasive article of claim 1, wherein the water-soluble polymer comprises at least one of a polyvinyl alcohol or a poly(vinylpyrrolidone).

4. The structured abrasive article of claim 1, wherein the backing comprises a film backing.

5. The structured abrasive article of claim 1, wherein the eroding particles comprise at least one of silicon carbide or aluminum oxide.

6. The structured abrasive article of claim 1, wherein the eroding particles have a lesser Mohs hardness than at least a portion of the abrasive particles.

7. The structured abrasive article of claim 1, wherein the solid overlayer is continuous.

8. The structured abrasive article of claim 1, wherein the precisely-shaped abrasive composites have a height, relative to the backing, in a range of from 10 to 525 micrometers.

9. The structured abrasive article of claim 1, further comprising an attachment interface layer affixed to the second major surface of the backing.

10. The structured abrasive article of claim 1, wherein the cross-linked polymeric binder comprises at least one component selected from the group consisting of acrylics, phenolics, epoxies, urethanes, cyanates, isocyanurates, aminoplasts, and combinations thereof.

11. The structured abrasive article of claim 1, wherein the abrasive particles are selected from the group consisting of aluminum oxide, fused aluminum oxide, heat-treated aluminum oxide, ceramic aluminum oxide, silicon carbide, green silicon carbide, alumina-zirconia, ceria, iron oxide, garnet, diamond, cubic boron nitride, and combinations thereof.

12. The structured abrasive article of claim 1, wherein the abrasive particles have a $D_{50}$ in a range of from 0.01 to 200 micrometers.

13. A method of abrading a workpiece, the method comprising:

frictionally contacting at least a portion of the topographically structured abrasive layer of the structured abrasive article of claim 1 with a workpiece while in the presence of water; and moving at least one of the workpiece or the topographically structured abrasive layer relative to the other to abrade at least a portion of the surface of the workpiece.

14. A method of making a structured abrasive article, the method comprising:

providing a structured abrasive article comprising:

a backing having first and second opposed major surfaces;

a topographically structured abrasive layer secured to the backing, the topographically structured abrasive layer comprising precisely-shaped abrasive composites, wherein the precisely-shaped abrasive composites comprise abrasive particles in a cross-linked polymeric binder, and wherein the abrasive particles have a $D_{50}$; and disposing a solid overlayer on at least a portion of the topographically structured abrasive layer, the solid overlayer comprising eroding particles with a Mohs scale hardness of at least 4 and a water-soluble polymer, wherein the eroding particles have a $D_{50}$ that is less than or equal to the $D_{50}$ of the abrasive particles, wherein the eroding particles are present in a volume ratio of 5 to 75 percent based on the total of eroding particles and water-soluble polymer combined, and wherein there is sufficient water-soluble polymer to retain the eroding particles in a dry state.

15. The method of claim 14, wherein said disposing the solid overlayer comprises:

coating a liquid mixture onto at least a portion of the topographically structured abrasive layer, the liquid mixture comprising the eroding particles, water-soluble polymer, and a liquid vehicle; and removing a sufficient amount of the liquid vehicle to provide the solid overlayer.

16. The method of claim 14, wherein the water-soluble polymer comprises at least one of a polyvinyl alcohol, a poly(vinylpyrrolidone), a poly(alkylene oxide), a copolymer of methyl vinyl ether and maleic anhydride, a cellulosic polymer, guar gum, or an acrylic polymer.

17. The method of claim 14, wherein the water-soluble polymer comprises at least one of a polyvinyl alcohol or a poly(vinylpyrrolidone).

18. The method of claim 14, wherein the eroding particles have a lesser Mohs hardness than at least a portion of the abrasive particles.

19. The method of claim 14, wherein the precisely-shaped abrasive composites have a height, relative to the backing, in a range of from 10 to 525 micrometers.

20. The method of claim 14, further comprising affixing an attachment interface layer to the second major surface of the backing.

* * * * *